United States Patent [19]

Kawata et al.

[11] Patent Number: 4,932,353

[45] Date of Patent: Jun. 12, 1990

[54] CHEMICAL COATING APPARATUS

[75] Inventors: Yoshinobu Kawata; Katsunori Fuchigami, both of Fukuoka, Japan

[73] Assignee: Mitsubishi Denki Kabushiki Kaisha, Japan

[21] Appl. No.: 279,721

[22] Filed: Dec. 5, 1988

[30] Foreign Application Priority Data

Dec. 18, 1987 [JP] Japan ..... 62-193235[U]
Feb. 22, 1988 [JP] Japan ..... 63-39915

[51] Int. Cl.[5] ..... B05B 1/24

[52] U.S. Cl. ..... 118/302; 118/52; 118/320; 118/666; 239/132.1; 239/139

[58] Field of Search ..... 118/52, 600, 302, 666, 118/667, 320; 427/240, 422; 425/5; 239/132.1, 133, 139, 135, 134

[56] References Cited

U.S. PATENT DOCUMENTS

| | | | |
|---|---|---|---|
| 2,676,843 | 4/1954 | Parsons et al. | 239/134 X |
| 2,779,690 | 1/1957 | Gaiser | 239/133 X |
| 3,000,759 | 9/1961 | Barsky et al. | 118/600 X |
| 3,445,262 | 5/1969 | Greck et al. | 118/302 X |
| 3,677,471 | 7/1972 | Deakin | 239/133 X |
| 4,675,140 | 6/1987 | Sparks et al. | 425/5 X |
| 4,827,867 | 5/1989 | Takei et al. | 118/52 X |

FOREIGN PATENT DOCUMENTS

| | | | |
|---|---|---|---|
| 59-82975 | 5/1984 | Japan . | |
| 60-100434 | 6/1985 | Japan . | |
| 214621 | 9/1987 | Japan | 118/52 |
| 62-279632 | 12/1987 | Japan . | |
| 700728 | 12/1953 | United Kingdom | 239/132.1 |

*Primary Examiner*—Richard L. Chiesa
*Attorney, Agent, or Firm*—Leydig, Voit & Mayer

[57] ABSTRACT

A chemical coating apparatus has a heat exchanger disposed along a pipe for transporting a chemical for adjusting the temperature of the chemical to a predetermined value through a corresponding flow of constant-temperature water. Further, a temperature detector is provided in the vicinity of a nozzle through which the chemical is discharged to detect the temperature of the constant-temperature water. Therefore, it is possible to make uniform the thickness of chemical films applied to objects.

8 Claims, 3 Drawing Sheets

CHEMICAL COATING APPARATUS

BACKGROUND OF THE INVENTION

1. Field of the Invention

The present invention relates to a chemical coating apparatus which has a chemical pipe through which a chemical flows, and a heat exchanger disposed along at least part of the chemical pipe and in which the temperature of the chemical is adjusted to a predetermined value by the heat exchanger.

2. Description of the Related Art

A chemical coating apparatus of this type is used in various forms. It is known, for example, as a resist coater which is used to apply a resist on the surface of a semiconductor wafer during the process of manufacturing semiconductor devices.

FIG. 1 shows the arrangement of such a known resist coater. With this apparatus, a semiconductor wafer 3 is attached by means of vacuum to a rotary chuck 2 disposed in a cup 1, a coating is applied by dropping resist liquid 5 onto the semiconductor wafer 3 while the wafer 3 is being rotated by the operation of a chuck rotating motor 4.

The resist liquid 5 applied to the semiconductor wafer 3 is supplied by a resist liquid supply device (not shown), and is then subjected to indirect exchange of heat in a heat exchanger 6 through which constant-temperature water 7 having an adjusted temperature circulates, thereby adjusting the temperature of the resist liquid 5. After the resist has had its temperature adjusted in this way, it flows through a chemical pipe 9, such as a Teflon tube, and is then discharged from a chemical nozzle 8 to coat the semiconductor wafer 3.

With the known resist coating apparatus, however, since the resist liquid 5 at the tip of the nozzle 8 is easily influenced by the peripheral temperature, the thickness of a resist film applied to the semiconductor wafer 3 tends to vary to a great extent. It is therefore difficult to control the thickness of the resist film, resulting in various problems. For instance, the film thickness may vary within the surface of a single semiconductor wafer, and it may also vary among a plurality of wafers.

SUMMARY OF THE INVENTION

The present invention has been accomplished to prevent the above-described problems. It is an object of the present invention to provide a chemical coating apparatus, such as a resist coater, which is capable of adjusting the temperature of the chemical, such as the resist, along its path of travel from a source to and including the discharge and which is thus capable of forming a film with a uniform thickness on the surface of an object, such as a semiconductor wafer.

Another object of the present invention is to provide a chemical coating apparatus which is capable of positively adjusting the temperature of the chemical to a predetermined value in spite of the fact that the chemical, such as a resist liquid, which is to be supplied to the surface of a semiconductor wafer, is influenced by the temperature of external air surrounding the chemical pipe.

According to one aspect of the present invention, a chemical coating apparatus comprises: a pipe having one end connected to means for supplying a chemical and the other end positioned opposite an object to be coated with the chemical for transporting the chemical chemical; a nozzle connected to the other end of the pipe for dropping the chemical to the surface of the object to be coated; a main heat exchanger disposed along at least part of the pipe for effecting exchange of heat with the chemical; and an auxiliary heat exchanger disposed between the main heat exchanger and the surrounding nozzle the part of the pipe that extends therebetween for effecting exchange of heat with the chemical.

According to another aspect of the present invention, a coating apparatus comprises: a chemical pipe having one end connected to means for supplying a chemical and the other end positioned opposite an object to be coated with the chemical for transporting the chemical; a nozzle connected to the other end of the pipe for dropping the chemical to the surface of the object to be coated; and a heat exchanger disposed along the pipe for adjusting the temperature of the chemical to a predetermined value by the flow of constant-temperature water through the best exchanger, the heat exchanger comprising a first heat exchanging pipe and a second heat exchanging pipe, the first heat exchanging pipe being disposed generally parallel to the pipe, and having one end connected to constant-temperature water circulating means and the other end disposed in and opening in the vicinity of the nozzle disposed at the other end of the pipe for the flow of constant-temperature therethrough, and the second heat exchanging pipe being disposed surrounding the first heat exchanging pipe and the pipe, and communicating with the end of the first heat exchanging pipe opening in the vicinity of the nozzle for the flow of constant-temperature water therethrough.

DESCRIPTION OF THE PREFERRED EMBODIMENTS

Figure 1:
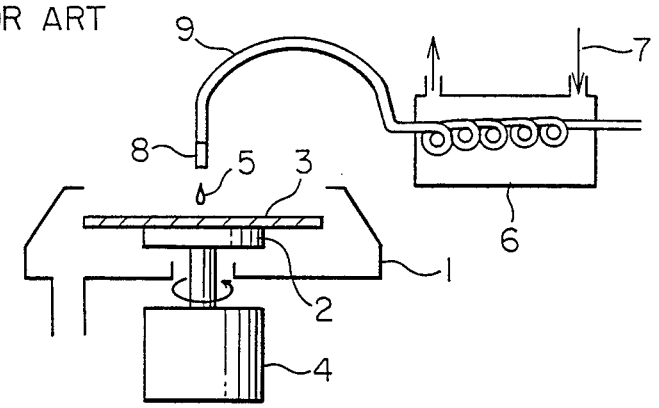
FIG. 1 PRIOR ART
FIG. 1 is a view schematically illustrating a known resist coater.
Figure 2:
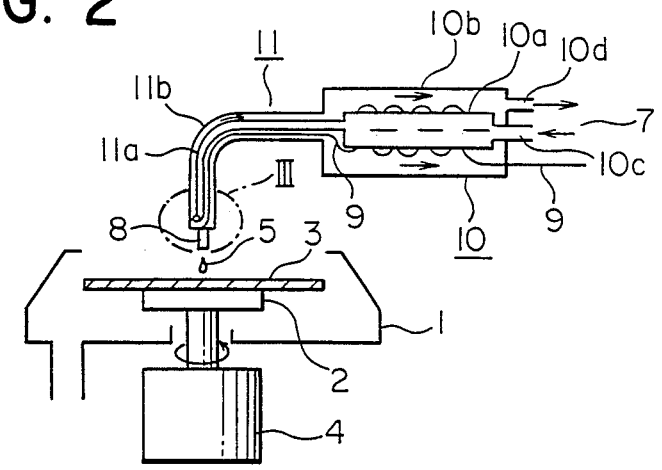
FIG. 2 is a sectional view schematically illustrating a resist coater in accordance with a first embodiment of the present invention.
Figure 3:
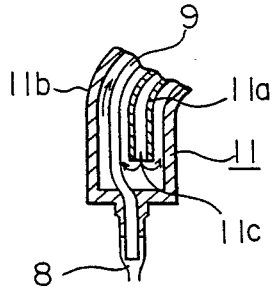
FIG. 3 is an enlarged sectional view of the part of the resist coater shown in FIG. 2 which is encircled by the broken line III in FIG. 2.

FIG. 2 shows the arrangement of a chemical coating apparatus in accordance with a first embodiment of the present invention. Referring to the figure, the apparatus has a pipe 9 through which a chemical 5, such as resist liquid, flows, and a nozzle 8 connected to the pipe 9. A main heat exchanger 10 is disposed in correspondence with at least a portion of the pipe 9, and is provided for effecting exchange of heat with the resist liquid 5. The interior of the main heat exchanger 10 is supplied with constant-temperature water 7 by a constant-temperature water circulating means (not shown) to enable adequate contact between the constant-temperature water 7 and the portion of the pipe 9 within heat exchanger 10. The main heat exchanger 10 has a conduit 10*a* provided with a constant-temperature water inlet 10*c*, and a jacket 10*b* disposed surrounding the conduit 10*a* and a portion of the chemical pipe 9, and provided with a constant-temperature water outlet 10*d* through which the constant-temperature water 7 is returned to the circulating means.

An auxiliary heat exchanger 11 is disposed along a part of the pipe 9 that extends from the main heat exchanger 10 to the nozzle 8 for effecting exchange of heat with the resist liquid 5. The auxiliary heat exchanger 11 has first and second heat exchanging pipes 11*a* and 11*b*. The first heat exchanging pipe 11*a* is connected to the conduit 10*a* to supply the constant-temperature water 7 through the conduit 10*a* is deposed generally parallel to that part of the pipe 9, and is provided with an end 11*c* opening in the vicinity of the nozzle 8. The second heat exchanging pipe 11*b* is disposed between the main heat exchanger 10 and the nozzle 8 surrounding the first heat exchanging pipe 11*a* and part of the pipe 9, in communication with the opening end 11*c* of the first heat exchanging pipe 11*a* and with the jacket 10*b* of the main heat exchanger 10 for the flow of the constant-temperature water 7 therethrough.

By virtue of this arrangement, the resist liquid 5 is subjected to temperature adjustment by the main and auxiliary heat exchangers 10 and 11 along the transport path the resist liquid 5 from its source the nozzle 8.

Next, the operation of the apparatus will be described. Resist liquid 5, which is to be applied to a semiconductor wafer 3 is supplied from a resist supply device (not shown) to that portion of the pipe 9, such as a Teflon pipe, disposed in the main heat exchanger 10. The resist liquid 5 is subjected to indirect exchange of heat in the heat exchanger 10 through which the constant-temperature water 7 at an adjusted temperature flows. Thereby, the temperature of the resist is adjusted. The constant-temperature water 7 is further sent to a point very close to the nozzle 8 by flowing in the auxiliary heat exchanger 11. The constant-temperature water 7 flowing in the heat exchanger 11 exchanges heat with the resist liquid 5 flowing in the Teflon tube 9. After exchange of heat, the constant-temperature water 7 is returned to the main heat exchanger 10.

In the apparatus according to the above-described embodiment, a single Teflon tube is used to supply resist liquid to the nozzle 8. However, the apparatus may alternatively use two or more Teflon tubes.

According to the first embodiment, the auxiliary heat exchanger 11 is provided to enable the adjustment of the temperature of the resist liquid 5 including at the nozzle, thereby enabling control over the temperature of the resist liquid 5. Consequently, it is possible to prevent variation in film thickness within the surface of a single semiconductor wafer and among a plurality of wafers, thereby enhancing the uniformity of film thicknesses.

Figure 4:
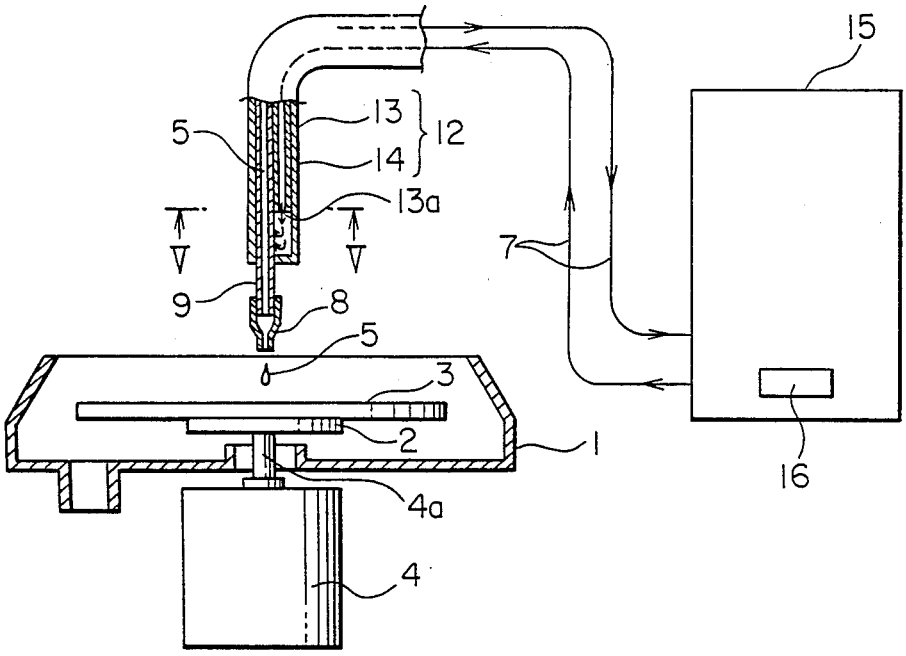
FIG. 4 is a sectional view schematically illustrating a resist coater in accordance with a second embodiment of the present invention.

FIG. 4 illustrates a second embodiment of the present invention. A resist coater illustrated there has a rotary chuck 2 supporting a semiconductor wafer 3 attached thereto by means of vacuum, a rotary shaft 4*a* supporting the rotary chuck 2, a motor 4 for driving the rotary shaft 4*a*, a spin cup 1 surrounding the semiconductor wafer 3 and the chuck 2, and a resist liquid nozzle 8 disposed at the tip of a resist liquid supply pipe 9 and positioned above the rotary chuck 2. When resist liquid 5 is to be applied to the semiconductor wafer 3, the resist liquid 5, serving as a chemical, is dropped from the resist liquid nozzle 8 to the surface of the semiconductor wafer 3 while the rotary chuck 2 is kept stationary or is being rotated at a low speed by the motor 4. Thereafter, the resist 5 is spread over the entire surface of the semiconductor wafer 3 by centrifugal force generated by the rotation of the rotary chuck 2 at a high speed, thereby forming a resist film, desirably, with a uniform thickness.

Figure 5:
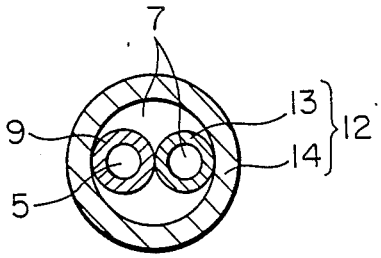
FIG. 5 is a cross-sectional view of a heat exchanger shown in FIG. 4 taken along the line V—V shown in FIG. 4.

In coating resist liquid, it is necessary to maintain the viscosity of the resist liquid at a predetermined value, and, to this end, the temperature of the resist liquid itself must be properly adjusted. For this purpose, the apparatus in accordance with this embodiment of the present invention is provided with a heat exchanger 12. The heat exchanger 12 has a predetermined length and a cross-sectional structure as shown in FIG. 5, and extends substantially the entire length of the resist liquid supply pipe 9 through which the resist liquid 5 flows from a resist liquid supply device (not shown) to the resist liquid nozzle 8. Further, the apparatus has an arrangement in which the temperature of the resist liquid 5 is adjusted to a predetermined set temperature, indirectly by constant-temperature water 7 which flows in opposite direction streams within the heat exchanger 12.

Moreover specifically, as best shown in FIG. 5, the heat exchanger 12 comprises a constant-temperature water supply pipe 13 disposed in close contact and parallel to the resist liquid supply pipe 9, and a constant-temperature water discharge pipe 14 disposed surrounding the pipe 13 and the resist liquid supply pipe 9. The constant-temperature water supply pipe 13 and the constant-temperature water discharge pipe 14 are connected to and communicate with a constant-temperature water circulating means 15 disposed outside the resist coater.

With this arrangement constant-temperature water 7 is supplied from the constant-temperature water circulating means 15 to the constant-temperature water supply pipe 13, flows in the pipe 13 to reach an opening end 13*a* of the pipe 13 where it changes its direction and flows into the constant-temperature water discharge pipe 14 to be returned to the circulating means 15. The constant-temperature water circulating means 15 has a controller (not shown) provided therein for adjusting the temperature of constant-temperature water 7 to a predetermined set temperature. A temperature sensor 16 is disposed at a supply port of the circulating means 15, and the temperature of the constant-temperature water 7 is controlled on the basis of the difference between the actual temperature of the water 7, which is detected by the sensor 16, and a pre-established temperature.

Similarly to the first embodiment, the above-described second embodiment achieves, if the apparatus is used to apply a chemical coating to an object (e.g., the semiconductor wafer 3), uniform thickness of chemical films applied to semiconductor wafers.

Figure 6:
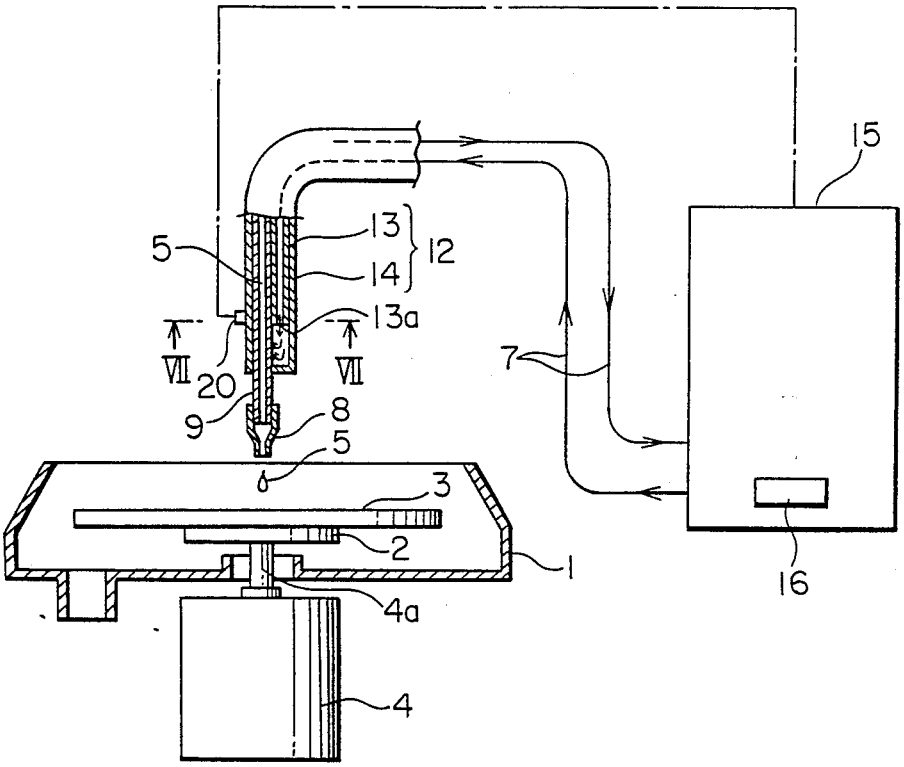
FIG. 6 is a sectional view schematically illustrating a resist coater in accordance with a third embodiment of the present invention.
Figure 7:
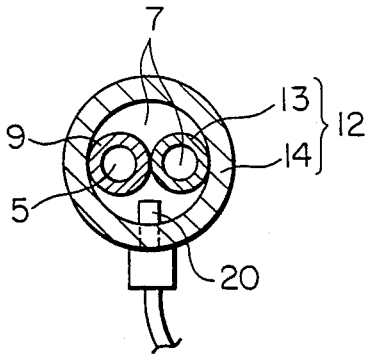
FIG. 7 is a cross-sectional view taken along the line VII—VII shown in FIG. 6.

FIG. 6 illustrates a third embodiment of the present invention. In the third embodiment, the basic arrangement and operation of the resist coater is the same as that in the second embodiment, except that the heat exchanger 12 is provided with a temperature detecting means 20 comprising a temperature measuring resistor. Therefore, in FIGS. 6 and 7, the same reference numerals as those in FIGS. 4 and 5 are used to indicate members which are the same as or correspond to those in the second embodiment, and detailed explanations of these members will be omitted.

A resist coater in accordance with this embodiment has a resist liquid supply pipe 9 for supplying resist liquid 5 to a nozzle 8, and a heat exchanger 12 of a predetermined length which is disposed along the pipe 9. The heat exchanger 12 comprises a constant-temperature water supply pipe 13 disposed in close contact and in parallel with the resist liquid supply pipe 9, and a constant-temperature water discharge pipe 14 disposed surrounding the pipe 13 and the resist liquid supply pipe 9. Each of these pipes 13 and 14 is connected to and communicates with a constant-temperature water circulating means 15 disposed outside of the resist coater. Further, a temperature detecting means, such as a temperature measuring resistor 20, is provided at an opening end 13*a* of the constant-temperature water supply pipe 13, at which constant-temperature water 7 which has been supplied from the circulating means 15 to the constant-temperature water supply pipe 13 flows out from the pipe 13, changes its direction of flow, and flows into the constant-temperature water discharge pipe 14. More specifically, the temperature measuring resistor 20 is provided inside the constant-temperature water discharge pipe 14 at a position in the vicinity of the point where the water 7 changes its direction of flow to detect the temperature of the constant-temperature water 7 at this point of flow direction change.

With the third embodiment, therefore, the temperature of the water 7 is detected by the temperature measuring resistor 20 after the water 7 has completed exchange of heat with the resist liquid 5 flowing through the pipe 9 been subjected to the air near the end of pipe 9. The constant-temperature water circulating means 15 has a controller (not shown) which controls the temperature of the water 7 on the basis of the thus detected actual temperature of the water 7. Constant temperature water 7 having had its temperature adjusted to a set temperature is supplied from the circulating means 15 to the supply pipe 13. Accordingly, the temperature of the resist liquid 5 which is to be dropped onto the surface of a semiconductor wafer 3 is adjusted by the constant-temperature water 7 whose temperature has been adjusted taking into consideration the influence of the external air surrounding the tip of the pipe 9. Therefore, the temperature of the resist liquid 5, which is adjusted by the constant-temperature water 7 that has had its temperature adjusted in this way, is kept from greatly deviating from the set temperature, thus achieving very precise temperature adjustment.

More specifically, according to the third embodiment, since the temperature of the constant-temperature water 7, flowing in opposite directions inside the heat exchanger 12 disposed along the pipe 9 through which the resist liquid 5 flows, is detected by the temperature measuring resistor 20 provided at a position in the vicinity of the point where the water 7 changes its direction of flow, that is, at a position in the vicinity of the opening end 13*a* of the constant-temperature water supply pipe 13, it is possible to detect the actual temperature of the water 7 after it has substantially completed exchange of heat with the 5 flowing through the chemical pipe 9 and has been subjected to the peripheral air temperature. The thus detected actual temperature of the water 7 provides an indirect measure of the actual temperature of the chemical 5.

Accordingly, when the temperature of the water 7 is controlled by the controller of the constant-temperature water circulating means 15 on the basis of the difference of the actual temperature detected by the temperature measuring resistor 20 and a pre-established temperature, it is possible to supply constant-temperature water 7, having a temperature that has been adjusted to the pre-established temperature, to the heat exchanger 12. This feature is effective to prevent the temperature of the chemical 5 from deviating from the pre-established temperature after the chemical temperature has been adjusted by the constant-temperature water 7. By virtue of the provision of the above-described arrangement, the resist coater is capable of positively adjusting the temperature of the resist liquid 5, which is to be supplied to the surface of a semiconductor wafer 3, to a predetermined temperature, thereby preventing variation in the thickness of the resist films caused by the peripheral air temperature, and thereby enabling resist films which are uniform in thickness to be formed on the surface of semiconductor wafers.

Although, in the foregoing descriptions, the present invention is applied to resist coaters, the present invention is not limited thereto. It may alternatively be applied to an apparatus requiring the adjustment of the temperature of a chemical, such as a developing apparatus.

What is claimed is:

1. A chemical coating apparatus comprising:

a chemical supply pipe having a first end connected to means for supplying a chemical and a second end positioned opposite an object to be coated with the chemical for transporting the chemical from the first end to the second end;

a nozzle connected to the second end of said pipe opposite the object for applying said chemical to the object to be coated;

a main heat exchanger disposed along at least part of said pipe for bringing at least part of said pipe into contact with a heat exchanging fluid for exchanging heat with said chemical comprising an inlet for admitting the heat exchanging fluid to said heat exchanger and an outlet for discharging the heat exchanging fluid from said main heat exchanger; and an auxiliary heat exchanger disposed between said main heat exchanger and said nozzle surrounding the part of said pipe that extends therebetween for exchanging heat with said chemical comprising a first heat exchanging pipe and a second heat exchanging pipe, said first heat exchanging pipe (i) being connected to said main heat exchanger for flow of the heat exchanging fluid from said main heat exchanger into said first heat exchanging pipe, (ii) being disposed parallel to at least part of said chemical supply pipe, and (iii) having an end opening in the vicinity of said nozzle, said second heat exchanging pipe being disposed (i) surrounding said first heat exchanging pipe and at least part of said chemical supply pipe, (ii) communicating with said end of said first heat exchanging pipe opening in the vicinity of said nozzle, and (iii) being connected to said main heat exchanger for the flow of the heat exchanging fluid thereto.

2. An apparatus according to claim 1, wherein said chemical coating apparatus is a resist coater, said chemical is a resist liquid, and said object to be coated is a semiconductor wafer.

3. A chemical coating apparatus comprising:

a chemical supply pipe having a first end connected to means for supplying a chemical and a second end positioned opposite an object to be coated with the chemical for transporting the chemical from the first end to the second end;

a nozzle connected to the second end of said pipe opposite the object for applying said chemical to the object to be coated; and a heat exchanger disposed along said pipe for adjusting the temperature of the chemical to a predetermined value, said heat exchanger comprising first and second heat exchanging pipes for the flow of a heat exchanging fluid therethrough, said first heat exchanging pipe being disposed parallel to at least part of said chemical supply pipe and having a first end for admitting the heat exchanging fluid and a second end disposed and opening in the vicinity of said nozzle, said second heat exchanging pipe being disposed surrounding said first heat exchanging pipe and at least part of said chemical supply pipe and communicating with said second end of said first heat exchanging pipe for the flow of the heat exchanging fluid therethrough.

4. An apparatus according to claim 3, wherein said chemical coating apparatus is a resist coater, said chemical is a resist liquid, and said object to be coated is a semiconductor wafer.

5. An apparatus according to claim 3 comprising temperature detecting means disposed in the vicinity of said second end of said first heat exchanging pipe for detecting the temperature of the heat exchanging fluid and for transmitting the detected temperature to means for controlling the temperature of the heat exchanging fluid.

6. An apparatus according to claim 5 wherein said temperature detecting means comprises a resistor having a resistance that varies with temperature.

7. An apparatus according to claim 5 wherein said first heat exchanging pipe is arranged for supplying the heat exchanging fluid and said second heat exchanging pipe is arranged for discharging the heat exchanging fluid.

8. An apparatus according to claim 3 wherein said heat exchanger is disposed along substantially the entire length of said chemical supply pipe.

* * * * *